US005326276A

United States Patent [19]

Cheng

[11] Patent Number: 5,326,276

[45] Date of Patent: Jul. 5, 1994

[54] CONNECTOR ASSEMBLY WITH DIMENSION-REDUCED TRANSVERSE WALL FOR EASY AND SAFE WITHDRAWAL OF THE BOARD INSERTED THEREIN

[75] Inventor: Lee Cheng, Cupertino, Calif.

[73] Assignee: Foxconn International, Inc., Sunnyvale, Calif.

[21] Appl. No.: 25,590

[22] Filed: Mar. 3, 1993

[51] Int. Cl.[5] ..... H01R 13/00

[52] U.S. Cl. ..... 439/326; 439/637

[58] Field of Search ..... 439/325, 326, 376, 377, 439/629-637

[56] References Cited

U.S. PATENT DOCUMENTS 2,417,369 3/1947 Luhn ..... 439/376

3,920,303 11/1975 Pittman et al. ..... 439/326

4,941,840 7/1990 Okada ..... 439/376

*Primary Examiner*—Joseph H. McGlynn

[57] ABSTRACT

A connector assembly for use with a unitary daughter board having different contact pitch arrangements on the lower edge portion, includes two different contact pitch arrangement connectors lengthwise aligned and juxtaposed with each other for commonly receiving the lower edge portion of the daughter board. The connector of the high density contact arrangement includes an outer end wall having a recess at the top for functioning as a pivoting point of the rotative movement of the daughter board without interference thereof. A middle partition wall of the same connector has the curved surface thereof in conformity with the rotation path of the daughter board.

7 Claims, 7 Drawing Sheets

CONNECTOR ASSEMBLY WITH DIMENSION-REDUCED TRANSVERSE WALL FOR EASY AND SAFE WITHDRAWAL OF THE BOARD INSERTED THEREIN

BACKGROUND OF THE INVENTION

1. Field of The Invention

The invention relates to connector assembly, especially to two connectors aligned and juxtaposed with each other and having different pitches with their respect contact arrangements.

2. The Prior Art

As shown in FIG. 1 and in U.S. Pat. Nos. 4,080,027, 4,288,139, 4,327,954 and 4,826,447, the conventional card edge connector includes an elongated insulative housing having a central slot lengthwise, two rows of contacts oppositely positioned along proximate two sides of the slot, respectively, for electrical engagement with the conductive pads on the lower edge portion of the board which is inserted into the slot. As shown in FIG. 2 and in U.S. Pat. Nos. 4,846,734, 4,934,961, 4,993,972, 5,024,609, 5,035,632, 5,156,554 and 5,156,554, the advanced card edge connector includes the similar housing structure for reception of a board, but generally has vertically or horizontally staggering contact arrangement by each side along the slot. This method allows for high density or small or half pitch contact arrangement for the card edge connector which facilitates the high speed and high quantity of the signal transmission within a computer to meet the requirements of the recent industry. It can be understood that due to the difficulties of manufacturing, the high density contact arrangement connector is much more expensive than the low density contact arrangement connector. It is also noted that though high density (fine pitch) contact arrangement is popularly used within the computer today, the traditional low density (regular pitch) contact arrangement connector still exists within the same computer because these two different pitch contact arrangement connectors are configured to function to accommodate the different inserted boards for different specific purposes to some of which the high density contact arrangement of the connector may not be required for cost-saving consideration.

In the recent trend, for the increasing competition and the reduced beneficial rate in the personal computer industry, the computer manufacturer is now trying every possible step to lower the cost for survival. Some of them have intentionally had these two different type connectors lengthwise aligned and juxtaposed with each other as a connector assembly, then using a larger unitary board which has two divided regions on its lower edge portion having different pitch arrangements of the conductive contacts thereabout, respectively, for corresponding reception within these two aligned but different type connectors, respectively. Through this attempt, one board incorporating two different type connectors replaces two boards incorporating two different type connectors, so it may save considerable expense in the boards' cost which is of the high percentage in the manufacturing cost of the computer. Even though this effort seems successful from the general viewpoint, some disadvantages may occur simultaneously.

It can be contemplated that the different density arrangements of the contacts of the connectors will result in different retention forces which act on these two different type connectors, respectively. It means that the insertion force or the withdrawal force of the lower edge portion(s) of the board(s) within these two different type connectors will be different from each other in the same unit length. In the conventional situation, using two separate boards incorporating these two different connectors has no problems. While, using only one board with divided two regions of the lower edge portion incorporating two different type connectors induces an intention of rotation of the board during simultaneous insertion or withdrawal of the board with regard to these two different type connectors due to the unbalanced and unequal forces being derived within these two different type connectors for the sake of the different pitch arrangements of the contacts therein. In other words, the friction force in the high density contact arrangement connector is much higher than that in the low density contact arrangement connector, and the board intends to rotate about the outer end of the high density contact arrangement connector during its insertion or withdrawal with regard to this connector assembly. This phenomenon is paid attention to by the computer manufacturer, and a rotation handling section is designedly positioned on one side of the board, which can be protrusively positioned about the outer end wall of the low density contact arrangement connector. Hence, the operator can easily hold that handling section to rotatively insert or withdraw the unitary board with regard to the connector assembly. This additional handling section facilitates the insertion and the withdrawal of the board with regard to the connector assembly, but ignores some limitations of the connector assembly itself.

It is popularly understood that for a conventional connector with regardless of either a high density or a low density contact arrangement, the incorporating board is perpendicularly inserted into or withdrawn from the connector housing, so that the transverse end walls or the partition wall for strength reinforcement are all designed to accommodate the inserted board in a perpendicular movement or access relation. In other words, the dimensions and the tolerances of these portions are not suit for any improper rotation movement of the board thereabout.

Referring top FIG. 3, a low density contact arrangement connector 10 and a high density contact arrangement connector 20 are aligned and juxtaposed with each other as a connector assembly on a mother board 3 and a unitary daughter board 4 is intended to incorporate these two connectors 10 and 20 simultaneously. The daughter board 4 has a series of, contacts 42 of a low density arrangement along a first region 42' of the lower edge portion and a series of contacts 43 of a high density arrangement on the second region 43' of the same lower edge portion thereof. A handling section 44 is positioned on one side of the board 4 which is close to the outer end of the low density contact arrangement connector 10. A recess 40 is positioned between the group of contacts 42 and the group of contacts 43 for receptively straddling two respective inner ends of these two connectors 10 and 20. The board 4 further comprises at least two indents 41 for respectively receiving the partition walls (not shown) of the connectors 10 and 20 each of which is positioned in the middle portion of connector, providing strength reinforcement and polarization. FIG. 4 discloses the rotation movement of the board 4, by means of the handling section 44, with regard to the connectors 0 and 20. And FIG. 5 shows a left portion of the connector 20 where the top portion 22 of the end wall 21 and the top portion 24 of the middle partition wall 23 may interfere with the board 4 during the rotation of the board 4 within the connector 20. This interference may cause structural crash around the end wall 21 or the partition wall 23 and make the whole connector 20 electrically or mechanically fail because the end walls 21 and the partition wall 23 provide the strength reinforcement for the whole structure of the connector 20.

Accordingly, an object of the present invention is to provide a connector assembly which has the advantage of unitary single board usage but without the risk of the structure failure to damage the electrical and mechanical contact between the connector assembly and the board.

SUMMARY OF THE INVENTION

In accordance with one aspect of the invention, the connector assembly includes, on a mother board, at least two lengthwise aligned and juxtaposed card edge connectors having different contact pitch arrangements, respectively. A unitary daughter board has at least two separate regions on its lower edge portion, which have different contact density arrangements, respectively, for receivable engagement with the corresponding connectors. Recesses are positioned on the lower edge portion of the daughter board for receiving the corresponding end walls or the middle partition walls of the connectors. The outer end wall of the high density contact arrangement connector is downwardly recessed to form a sufficient space at its top for easy rotation of the daughter board thereabout. Convex surfaces extend respectively along the top portions of the outer end wall and the middle partition wall in compliance with the rotation paths of the corresponding side edge or recess of the board, so that no interference occurs between the daughter board and the connector assembly.

Further, the outer end wall of the high density contact arrangement connector may not only have the lower top surface than other transverse walls for compliance with the rotation of the daughter board but also have a larger cross-sectional dimension than other transverse walls for functioning as a strong supporting pivot of such rotation of the daughter board.

DETAIL DESCRIPTION OF THE PREFERRED EMBODIMENTS

Reference will now be made in detail to the preferred embodiments of the invention. While the present invention has been described with reference to a few specific embodiments the description is illustrative of the invention and is not to be construed as limiting the invention. Various modifications to the present invention can be made to the preferred embodiments by those skilled in the art without departing from the true spirit and scope of the invention as defined by the appended claims.

Figure 1:
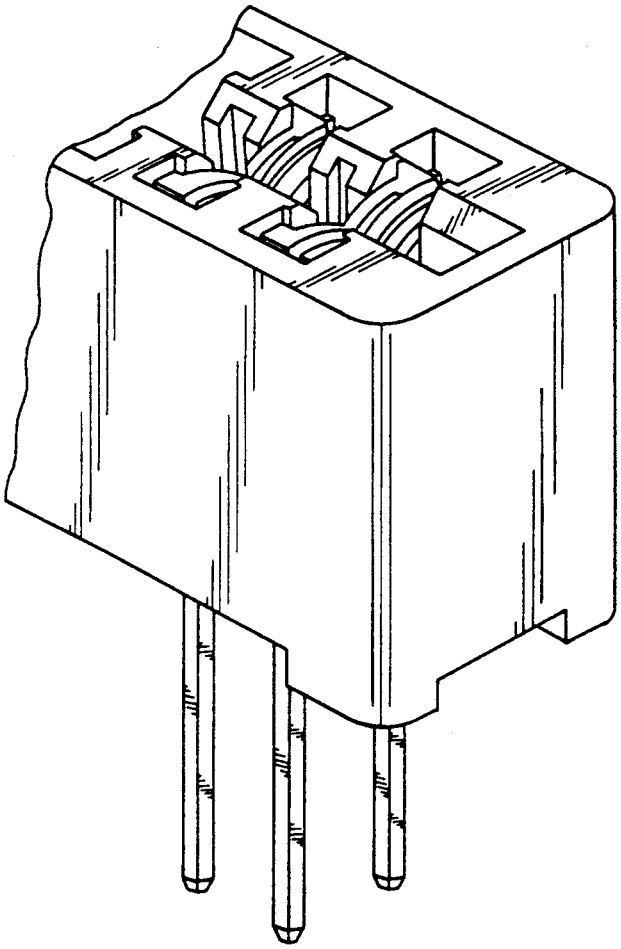
FIG. 1 PRIOR ART
FIG. 1 is a fragmentary perspective view of a conventional low density (regular pitch) contact arrangement connector.
Figure 2:
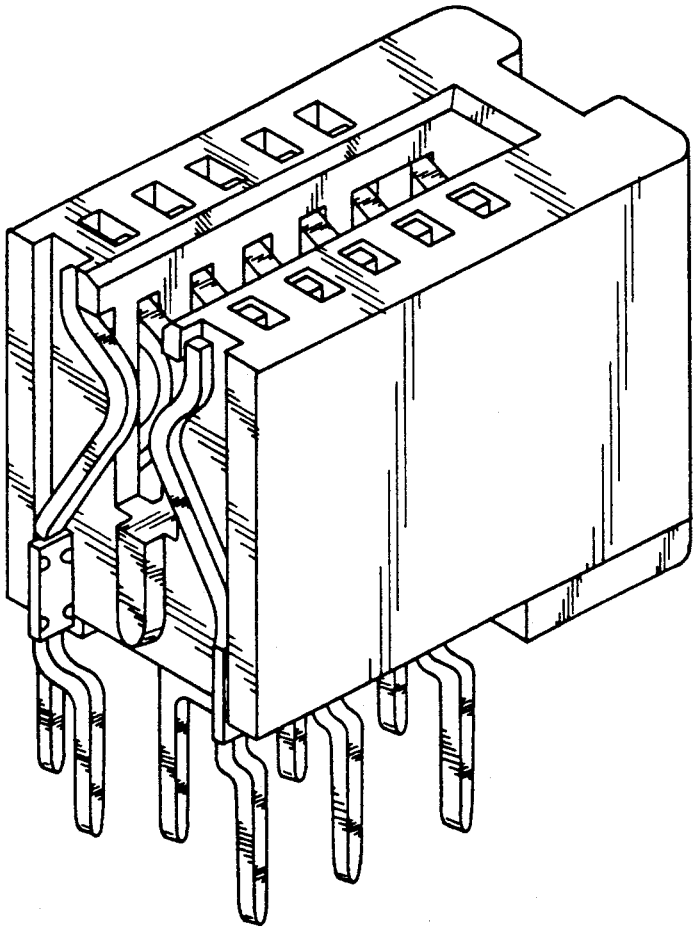
FIG. 2 PRIOR ART
FIG. 2 is a fragmentary perspective view of a conventional high density (fine pitch) contact arrangement connector.
Figure 3:
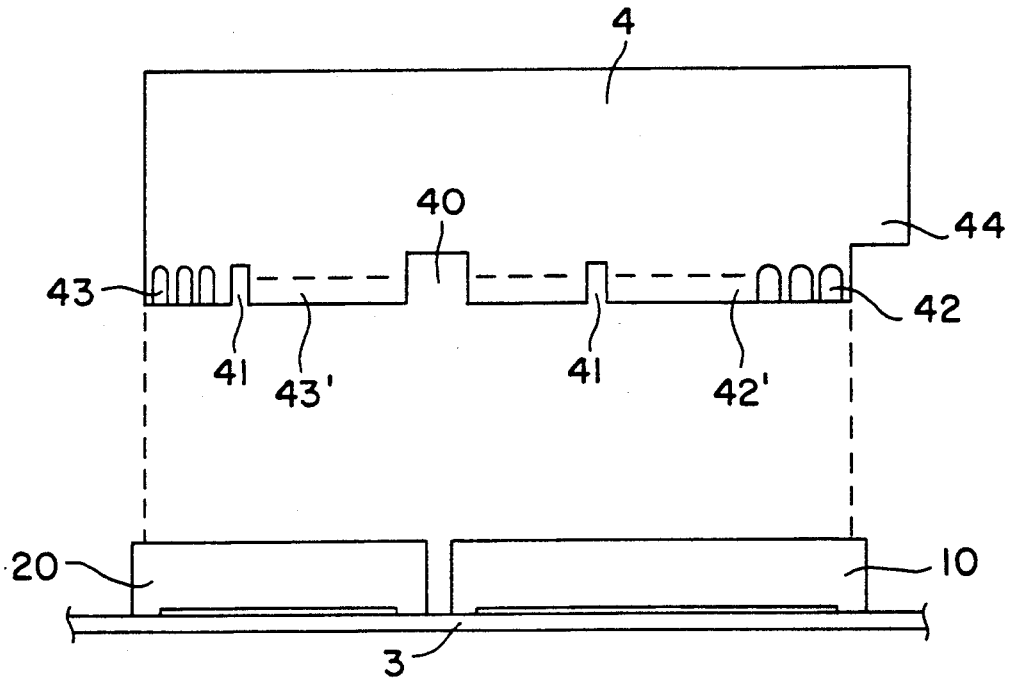
FIG. 3 PRIOR ART
FIG. 3 is a front plane view of the prior art connector the connectors have different contact pitch arrangements and the board has two separate regions with different contact pitch arrangements thereof for corresponding to the connectors, respectively.
Figure 4:
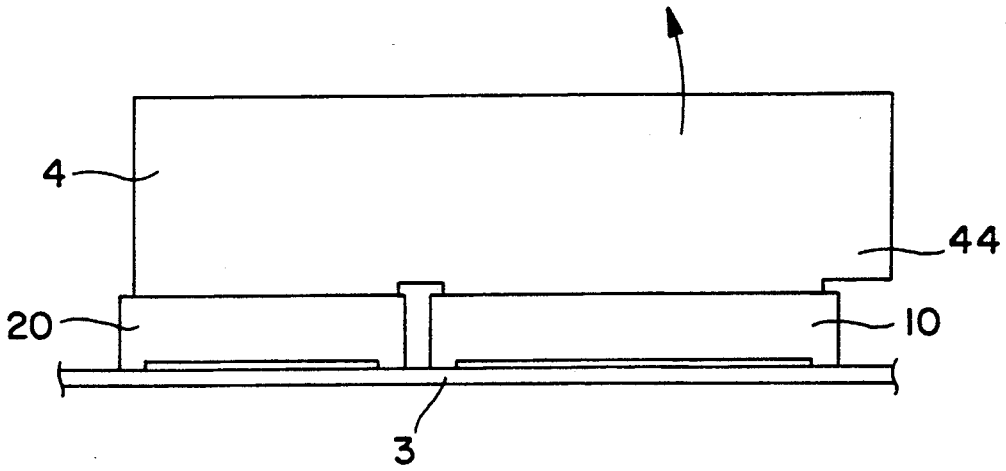
FIG. 4 PRIOR ART
FIG. 4 is a front plane view of the connector assembly and the board in FIG. 3 assembled together to show the withdrawal of the board from the connector assembly by a rotational movement.
Figure 5:
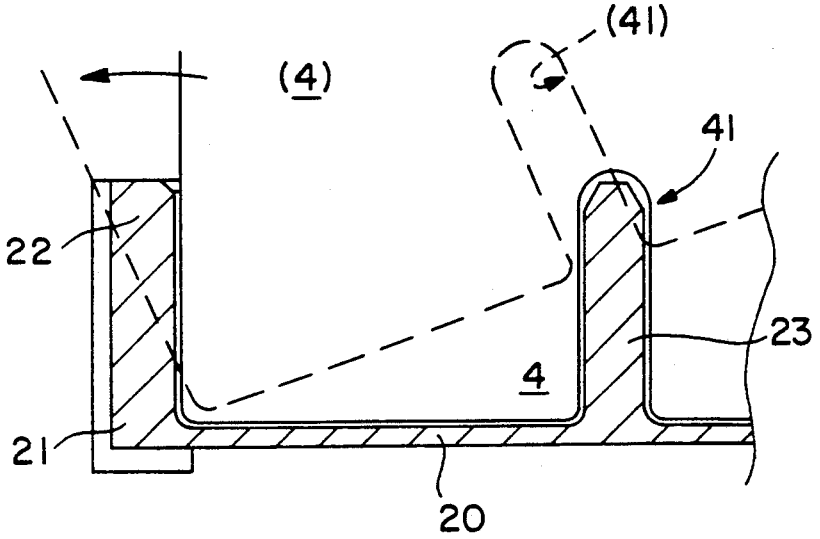
FIG. 5 is a vertical cross-sectional view of a left portion of the connector having the high density contact arrangement thereof without showing such contacts therein to show the interferences occurring around the end wall and the partition wall thereof.
Figure 6:
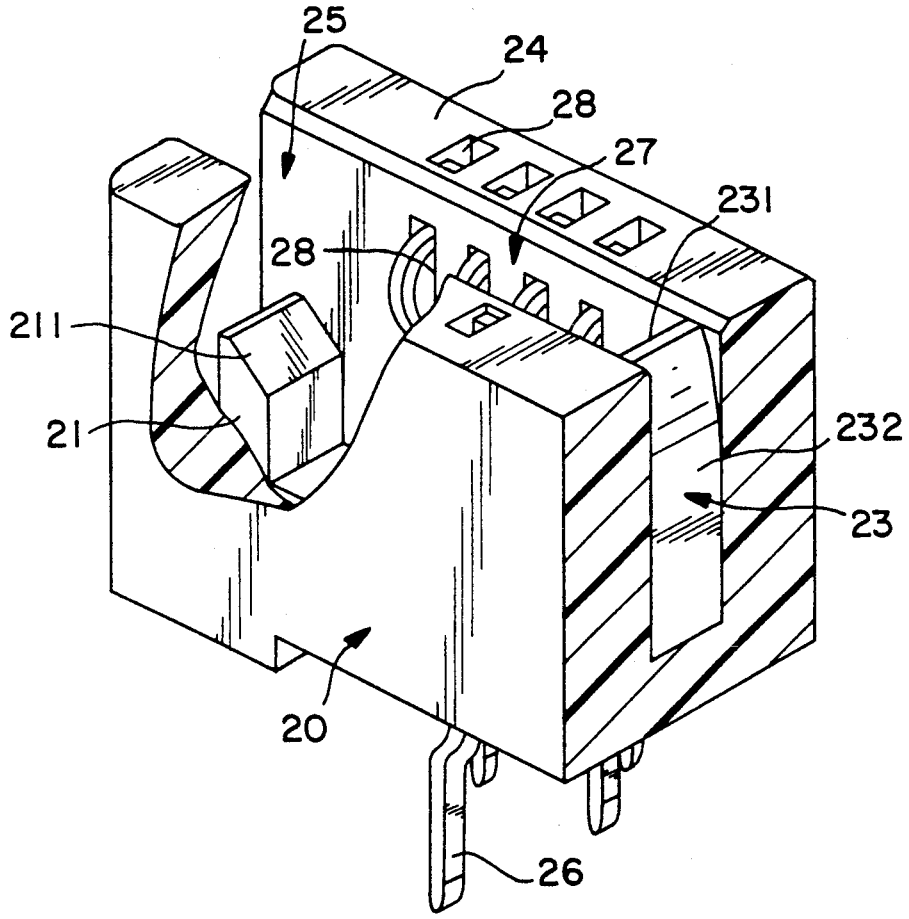
FIG. 6 is a fragmentary and portioned cut-out perspective view of a connector of a presently preferred embodiment according to the present invention, having high density contact arrangement thereof to show the outer end wall having a space at the top and the middle partition wall having convex configurations on the top portions.
Figure 7:
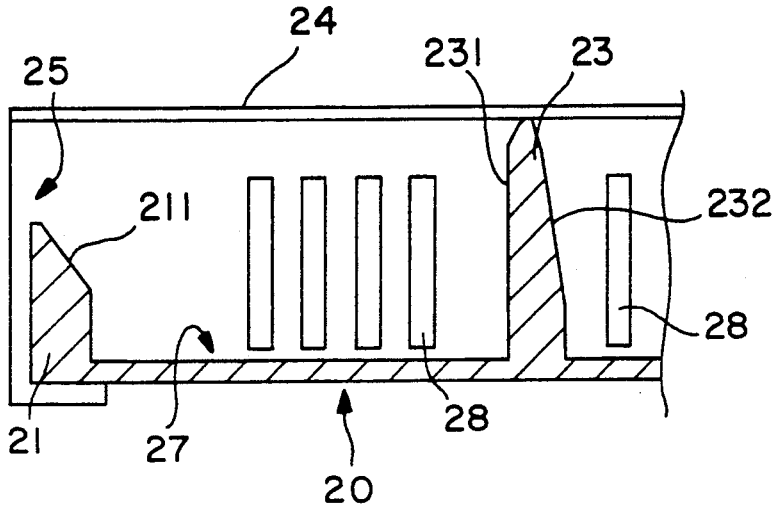
FIG. 7 is a fragmentary vertical cross-sectional view of the connector of FIG. 6 without contacts therein.

It will be noted here that for a better understanding, like components are designated by like reference numerals throughout the various figures hereinafter. Attention is now directed to FIGS. 6 and 7, where the subject card edge connector, generally designated 20, is of a high density contact arrangement as disclosed in FIG. 3 which is lengthwise aligned and juxtaposed with another low density contact arrangement card edge connector to form a connector assembly on a mother board for commonly but respectively receiving two separate regions of the lower edge portion of the daughter board wherein two regions are of different contact pitch arrangements for conductively engagement with the corresponding connectors, respectively. Based on the fact that in the present embodiment, the relevant mother board, the daughter board and the low density contact arrangement card edge connector may be similar to those in the prior art, such components may be back referred to FIGS. 3–5 for generally understanding the relationship among such components of the whole connector assembly. Accordingly, preferred embodiment of the present invention may only focus on the connector 20 which is configured of the high density contact arrangement. The connector 20 may have staggering high density contacts 26 received in the corresponding passageways 28 beside the central slot 27. It is noted that the connector 20 has transversely an outer wall 21 and an inner wall (not shown) at two opposite ends, and at least a transverse middle partition wall 23 with regard to the lengthwise direction for orientation of the daughter board within the connector 20.

According to the previous description of the prior art, the daughter board may be rotated about the outer end wall of the connector 20 when used with this connector assembly. Therefore, a transverse outer end wall 21 of the connector 20 is downwardly recessed at its top to form a space 25 for allowing for passage of the board during rotation. In this embodiment, the height of the outer end wall 21 is generally half of that of the other portions of the connector. In other words, the top end of the outer end wall 21 is positioned much more below the top surface 24 of the connector 20.

Figure 8:
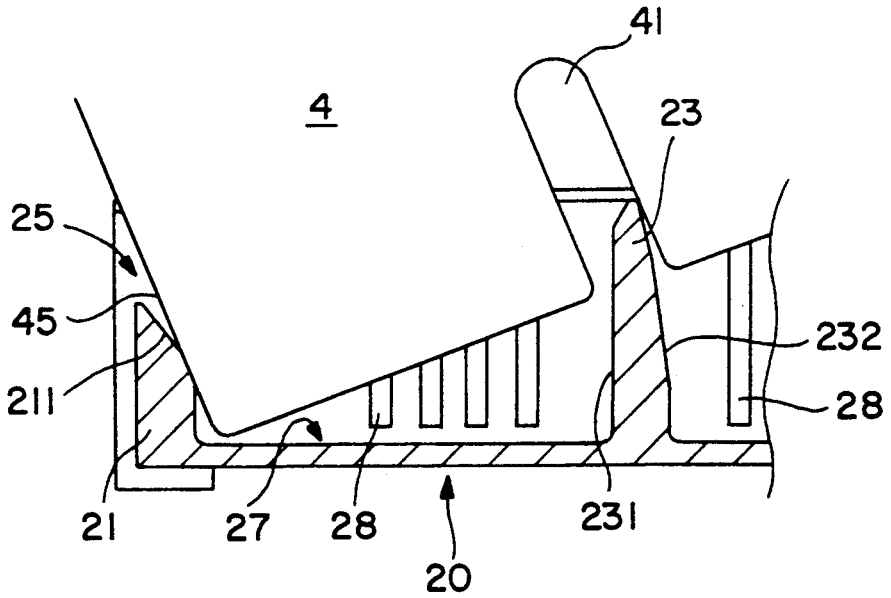
FIG. 8 is a fragmentary vertical cross-sectional view of the connector of FIG. 7 to show the daughter board is rotated about the outer end wall without interference occurring thereof.

The transverse middle partition wall 23 extends vertically in the connector 20. The partition wall 23 includes a first and a second side surfaces 231 and 232 oppositely facing to the outer wall 21 and the inner wall (not shown), respectively, wherein the second surface 232, i.e., the side surface which faces to a opposite direction to the outer end wall 21, is configured curved in compliance with the rotative moving path of the recess 41 of the daughter board 4 about the outer end wall 21 such that no structural crash due to improper interference occurs thereof. In this embodiment, because the outer end wall 21 functions as a support point which is deemed as a pivot of the rotation of the board, the top portion of the outer end wall 21 has an inclined top surface 211 upwardly and slantingly facing to the inserted board. Therefore, the board 4 can be stably rotated about the outer end wall 21 by means of the slidable and conformable engagement of the side edge 45 of the board 4 with the inclined top surface 21 of the outer end wall 21, as shown in FIG. 8. Moreover, if necessary or if the structure strength of the partition wall 23 is strong enough, through a proper dimensioned and shaped curved side surface 232, under the condition that no improper interference is induced thereof, the partition wall 23 may be used as a secondary support point for the rotation of the daughter board 4 by means of the slidable and conformable engagement of the recess 41 of the daughter board 4 and the side surface 232 of the partition wall 23.

Figure 9:
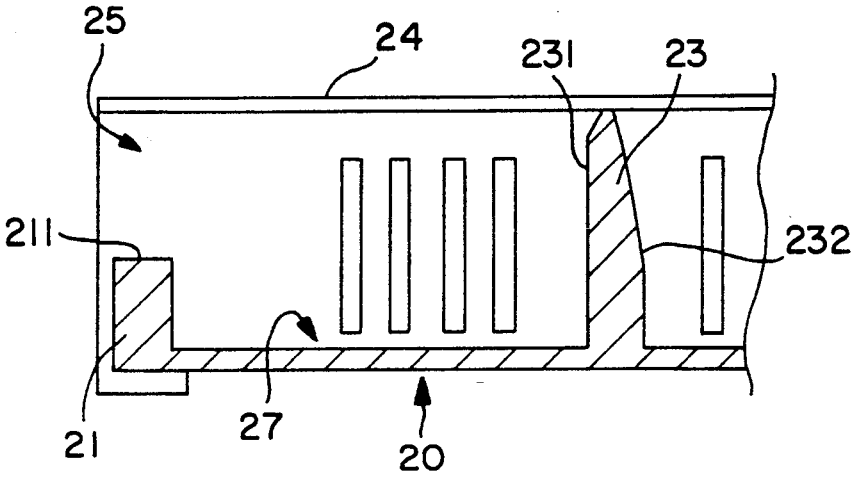
FIG. 9 is a fragmentary vertical cross-sectional view of the connector of another embodiment, without showing contacts therein, according to the present invention.
Figure 10:
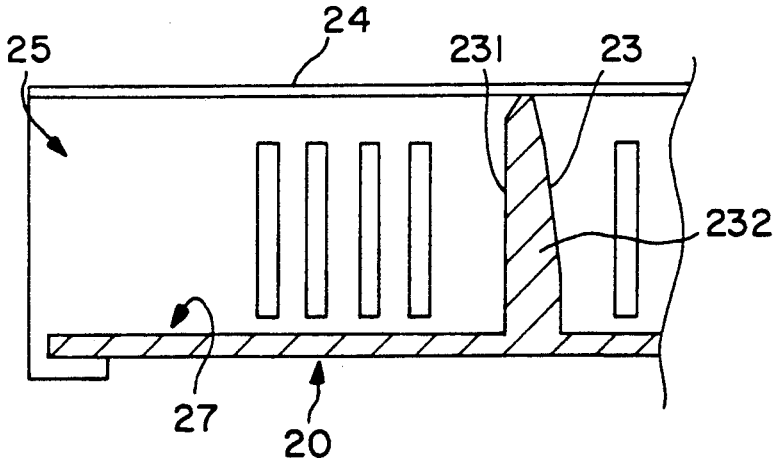
FIG. 10 is a fragmentary vertical cross-sectional view of the connector of the third embodiment, without showing contacts therein, according to the present invention.

It can be appreciated that the configurations and the dimensions of the space 25 and the inclined top surface 211 of the outer end wall 21 should be designed for the consideration of the balance between the structure strength of the connector 20 and the smooth rotative movement of the board 4 without interference thereabout. Because the outer end wall 21 is originally designed to function as a transverse wall for structural reinforcement, any reduced dimension of the outer end wall 21 should not jeopardize the structural function thereof. Accordingly, if necessary, in this embodiment, the outer end wall 21 may be widened in the lengthwise direction to maintain the basic dimensions required by structure strength consideration for compensation for the space 25 and the inclined top surface 211 thereof. In contrast, under the premise that the molding material of the connector housing is strong enough to maintain the electrical and mechanical requirements of the whole structure regardless of existence of the outer end wall 21, the outer end wall 21 may be dimensioned as short as possible with a flat top surface 211 as shown in FIG. 9 for easy manufacturing, and even be totally removed therefrom as shown in FIG. 10.

It can be noted that the curved surface 232 of the partition wall 23 avoids interference with the board 4 when the board 4 is in rotation thereabout. Similarly, the side edge 45 of the board 4 can pass through the space 25 above the outer end wall 21 and supported by the inclined surface 211 of the outer end wall 21 for rotation thereabout. Accordingly, based on the configuration of the present invention, the outer end wall 21 or the middle partition wall 23 are not be damaged by interference with the board 4 due to the rotation of the board 4.

It can be understood that in the present embodiments, only the outer end wall 21 and the middle partition wall 23 of the high contact density connector 20 are thoughtfully reconfigured for conformation to the rotative path of the board. In other words, the other low contact density connector which is juxtaposed with the connector 20 is not paid the same attention to regarding the same issue. The reason is that the substantial pivot of the board rotation is set at the outer end wall 21 of the (high contact density) connector 20, so the for any rotations with the same vertical displacement, i.e., the height of the transverse walls as considered to be barriers which the board need to pass over, the lengthwise or horizontal displacement of a particle which is closer to the pivoting point, is larger than that of another particle which is farther from the same pivoting point. Therefore, the partition wall 23 which is closer to the outer end wall 21, i.e., the pivoting point, is provided with the curved surface thereof for compensation for the horizontal displacement of the corresponding portion of the rotative board 4; in contrast, the end wall or the partition wall of another low contact density connector which is positioned at another end of the whole connector assembly, are much farther from the outer end wall 21 than the partition wall 23 of the connector 20, so their derived lengthwise displacements for the same vertical displacement, i.e., the heights of the transverse walls, are a little smaller than that of the partition wall 23 and may be ignored under the condition that such minor horizontal displacements may be absorbed by the tolerances or the clearances of the related portions. Certainly, if necessary, the same reconfiguration of the low contact density connector which is beside the high contact density connector 20, may be implemented by using the similar method as used in the high contact density connector 20.

While the present invention has been described with reference to a specific embodiment, the description is illustrative of the invention ad is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A connector assembly at least comprising:

a first and a second card edge connectors (20, 10), each including an elongated housing having a central slot (27) therein, and a plurality of contacts (26) arranged along two sides of the slot (27), said first and second connectors (20, 10) lengthwise aligned and juxtaposed with each other on a mother board (3) for respectively receiving at least two separate regions (43',42') of a lower edge portion of a unitary daughter board (4), said regions (43', 42') having different contact pitch arrangements thereof, said first connector (20) having higher contact density arrangement than the second connector (10) for electrical engagement with the region (43') of the daughter board which is of a smaller contact pitch arrangement than the other region (42');

the improvement comprising:

said first connector (20) including an outer end wall (21) positioned at an end thereof in a lengthwise direction and far from the second connector (30), said outer end wall (21) being recessed at the top to form a substantial space (25) thereof, a top surface (211) of the outer end wall (21) being much lower than a general top surface (24) of the first connector (20), so that said outer end wall (21) functions as a supporting pivot for stabilizing a rotative movement of the daughter board (4) without interference occurring thereof.

2. The connector assembly as described in claim 1, wherein the first connector (20) further comprises a middle partition wall (23) transversely positioned to the slot (27), a surface (231) of said partition wall (23), which faces in a direction away from the outer end wall (21), being configured curved in compliance with a path of the rotative movement of the daughter board (4).

3. The connector assembly as described in claim 1, wherein the outer end wall (21) is widened along the lengthwise direction for structural reinforcement thereabout.

4. The connector assembly as described in claim 1, wherein the outer end wall (21) has an inclined surface (211) on the top for conformable engagement with a side edge of the daughter board (4) during rotation of the board (4).

5. A high contact density card edge connector for use with another aligned low contact density card edge connector comprising:

an elongated housing having a central slot and a plurality of high density arrangement contacts therein for electrical and mechanical engagement with a lower edge portion of a daughter board which is inserted into the slot;

said high contact density card edge connector comprising at least one transverse wall for orientation of the inserted daughter board, said transverse wall having a generally curved transverse surface for avoiding any interference with the daughter board when said board is rotatively moved about one lengthwise end of said high contact density card edge connector wherein said curved transverse surface faces in a direction away from said end.

6. The connector as described in claim 5, wherein said end includes a outer end wall having a recess at the top for avoiding interference.

7. The connector as described in claim 6, wherein said outer end wall further has an inclined top surface thereon.

* * * * *